US005507396A

United States Patent [19]

Hauch

[11] Patent Number: 5,507,396

[45] Date of Patent: Apr. 16, 1996

[54] ROTATING SIZER WITH SCREEN PANELS

[75] Inventor: David A. Hauch, Afton, Minn.

[73] Assignee: Carter Day International, Inc., Minneapolis, Minn.

[21] Appl. No.: 346,490

[22] Filed: Nov. 29, 1994

[51] Int. Cl.[6] ..... B07B 1/49

[52] U.S. Cl. ..... 209/399; 209/290; 209/406; 209/410

[58] Field of Search ..... 209/288, 289, 209/290, 297, 397, 399, 405, 406, 409, 410, 411, 412

[56] References Cited

U.S. PATENT DOCUMENTS

| | | | |
|---|---|---|---|
| 779,149 | 1/1905 | Cross . | |
| 1,284,669 | 11/1918 | Haug . | |
| 1,427,031 | 8/1922 | Stepp . | |
| 1,771,996 | 8/1930 | Chapman | 209/289 |
| 2,204,835 | 6/1940 | Traylor | 209/399 |
| 2,392,812 | 1/1946 | Faris et al. | 209/406 X |
| 4,184,944 | 1/1980 | Tytko | 209/288 |
| 4,222,865 | 9/1980 | Valeri et al. | 209/399 |
| 4,670,136 | 6/1987 | Schmidt et al. | 209/403 |
| 5,049,262 | 9/1991 | Galton et al. | 209/399 |
| 5,213,217 | 5/1993 | Galton et al. | 209/399 |
| 5,346,071 | 9/1994 | Page et al. | 209/257 |
| 5,377,846 | 1/1995 | Askew | 209/399 X |

FOREIGN PATENT DOCUMENTS

| | | | |
|---|---|---|---|
| 679552 | 8/1939 | Germany | 209/406 |

*Primary Examiner*—William E. Terrell
*Assistant Examiner*—Tuan Nguyen
*Attorney, Agent, or Firm*—Craig M. Gregersen; Briggs and Morgan

[57] ABSTRACT

The present invention provides a trommel having a plurality of screen panels whose longitudinally extending edges are disposed within a channel formed in a longitudinally extending rib member and fastened in place.

18 Claims, 3 Drawing Sheets

ROTATING SIZER WITH SCREEN PANELS

FIELD OF THE INVENTION

The present invention relates rotating sorting or sizing apparatus in general and to a rotating sizer having a multiplicity of screen panels.

BACKGROUND OF THE PRESENT INVENTION

Rotating sorters or sizers, commonly called trommels, are well known in the art of classifying grains, stones, etc., by their size. They typically have a cylindrical or regular polygonal cross section and include a frame structure supporting either a single screen unit conforming to the frame structure or individual panel sections attached to the frame structure and to each other. Representative examples of such rotating sizers can be found in U.S. Pat. No. 779,149 to Cross; U.S. Pat. No. 1,284,669 to Haug; U.S. Pat. No. 1,427,031 to Stepp; U.S. Pat. No. 2,204,835 to Traylor; U.S. Pat. No. 4,184,944 to Tytko; U.S. Pat. No. 4,222,865 to Valeri et al.; U.S. Pat. No. 4,670,136 to Schmidt et al.; U.S. Pat. No. 5,049,262 to Galton et al.; U.S. Pat. No. 5,213,217 to Galton et al.; and U.S. Pat. No. 5,346,071 to Page et al. The single wrap around screen has the advantage of being fairly easy to attach to the frame structure. They present a problem however in that as the rotating load within the sizer shifts with the rotation thereof, the screen is constantly flexing downwardly. Since the screen is often attached only along its two longitudinal edges to each other and along its circumferential edges to the frame structure, the load carried by the screen causes cracking along the circumferential edges thereof. That is, as the trommel was rotated, the screen would continuously deform with each revolution thereof, leading to life cycle fatigue and cracking along the attached circumferential edges. To avoid this loading problem and the life cycle fatigue caused thereby, many of the devices disclosed in the prior art have utilized a screen panel construction. This reduces the prior art loading problem, but the sizer constructions disclosed therein are complex and difficult to construct.

It would be desirable to have a sizer or trommel that utilizes multiple screen panels to reduce the fatigue caused by the rotating load but that is simpler in construction and costs less to build than the prior art structures.

SUMMARY OF THE INVENTION

It is an object of the present invention to provide new and improved apparatus that is not subject to the foregoing disadvantages.

It is another object of the present invention to provide an improved trommel that utilizes multiple screen panels attached to a rotatable frame that is easy to assemble.

It is still another object of the present invention to provide an improved trommel that includes a multiplicity of screen panels attached along their longitudinal edges to a rotatable frame structure.

The foregoing objects of the present invention are provided by a trommel having a rotatable frame and a plurality of screen panels attached thereto. The frame includes a plurality of U-shaped channel members that extend longitudinal between the ends of the trommel. The screen panels each have a pair of longitudinal edges that are disposed in the channels. More specifically, the disclosed trommel screen attached to the frame comprises a plurality of screen panels, typically six to eight, that are attached to each other and to the trommel frame along their elongate edges. Each screen panel includes a pair of longitudinally extending L-shaped flanges that are disposed within the frame channel in the trommel frame and clamped within the channel by a clamp bar. By attaching the screen panels along their longitudinally extending edges, the deformation of the screen due to the weight of the product in the trommel is reduced and the fatigue on the screen is minimized.

The foregoing objects of the invention will become apparent to those skilled in the art when the following detailed description of the invention is read in conjunction with the accompanying drawings and claims. Throughout the drawings, like numerals refer to similar or identical parts.

DETAILED DESCRIPTION OF THE INVENTION

Figure 1:
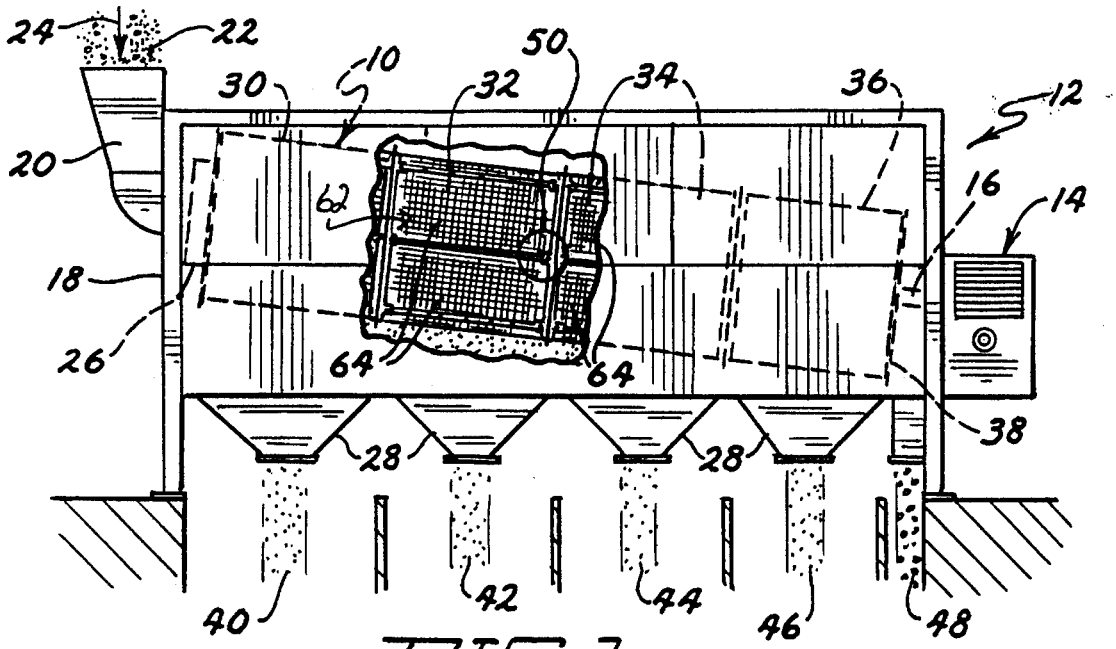
FIG. 1 shows a sizer apparatus or trommel wherein the present invention may find application.

The present invention will be described with reference to the embodiment shown in the accompanying drawings. Thus, FIG. 1 shows a trommel 10 in accord with the present invention. Trommel 10 is mounted for rotational operation in a sizer 12. Sizer 12 can include one or more trommels with varying screen sizes to provide for multiple sortings of grain, etc., within a single sizer unit. Trommel 10 is rotated by known means, such as a direct drive gear system or a chain drive system, indicated at 14, that drivingly engages a shaft or axle 16 that extends through the center of the trommel 10. Trommel 10 is enclosed within a housing 18 that, among other functions, serves to reduce the amount of noise released into the ambient environment and serves to protect individuals from injury by reducing the opportunity for someone to injuriously engage the operating machinery. Housing 18 includes a hopper 20 into which the particulate matter 22 to be sorted, whether it be grain or other material, is placed. The particulate matter generally falls into the hopper 20 under the influence of gravity, as indicated by arrow 24. From the hopper 20, the particulate matter 22 enters the upper or entrance end 26 of the rotating trommel 10. The material 22 is sorted by the rotating trommel screens, with the sorted material falling through the holes in the screens and out of the housing 18 through exit chutes 28 into the appropriate collection system below, which may be bins or a conveyor system of known type.

Referring still to FIG. 1, sizer 10 includes a single trommel comprising a plurality of screening sections arranged end to end. Thus, trommel 10 includes screening section 30 (shown in phantom), which is the inlet section of the trommel 10, center sections 32 and 34 (section 34 being shown partially in phantom), and outlet section 36 (shown in phantom). Each of theses screening sections may include screens having sizing or sorting apertures of the same size and configuration, or they may be differently sized and configured, thus providing for sorting of a variety of sizes of particles. For example, where the material is grain that has come straight from the field, the trommel may contain a screeening section that passes sand and fine seeds such as weed seeds, a section that passes grains of a particular girth, a section that passes grain of the same or a different girth, and a section to pass the remainder of the grain, thereby leaving only large objects such as rocks or stones of a certain size to exit from the trommel 10 through the exit end 38 thereof. In the Figure the material sorted from the first section 30 is indicated at 40, from the second section 32 at 42, from the third section 34 at 44, from the fourth section 36 at 46 and from the entire trommel 10 at 48.

While the foregoing description of the particular trommel or rotating sorter or sizer shown in FIG. 1 is indicative of the type of unit in which the present invention may find application, it should be understood that the present invention can find application in other forms of such apparatus and that the present invention is not limited to the particular trommel shown in FIG. 1. It will be observed that a circled area 50 has been indicated on FIG. 1. This area has been enlarged in FIG. 2 to indicate with greater particularity features of the present invention.

Figure 2:
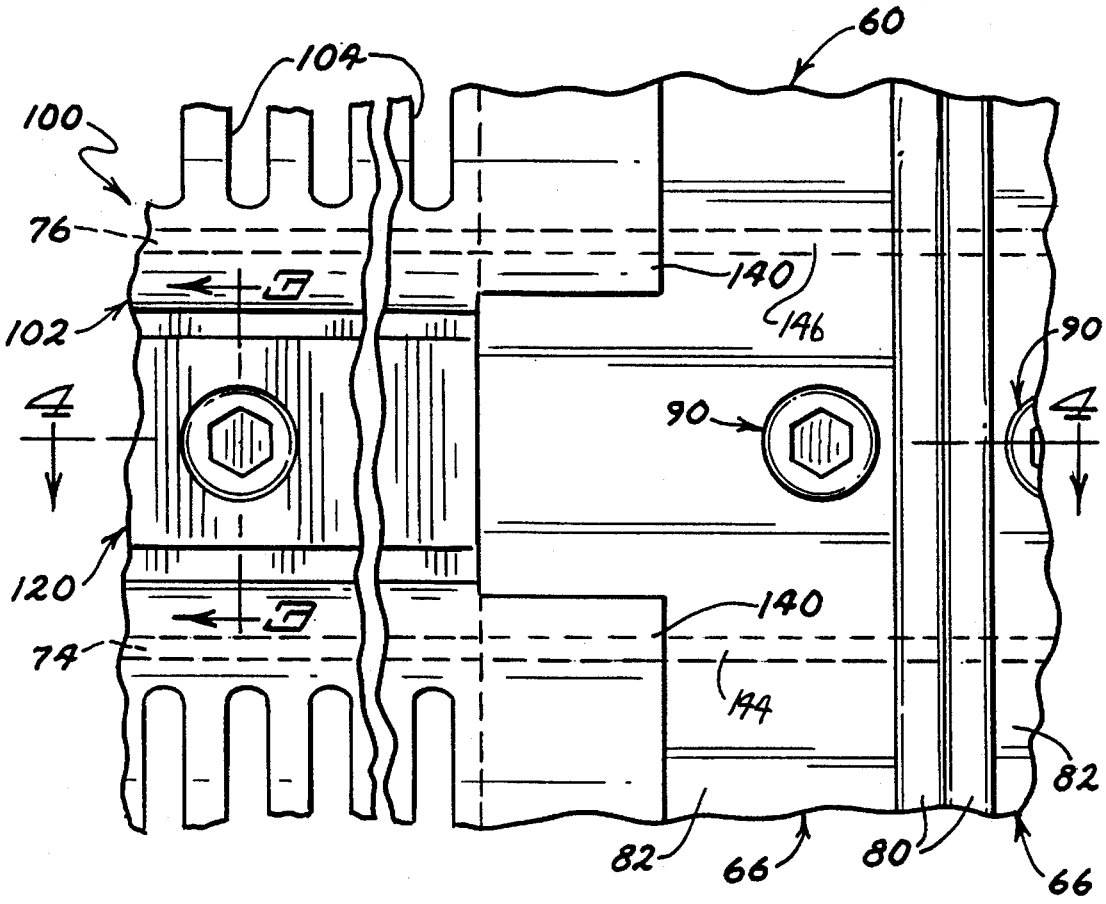
FIG. 2 an expanded view of the portion of the sizer apparatus circumscribed by the circle in FIG. 1.
Figure 4:
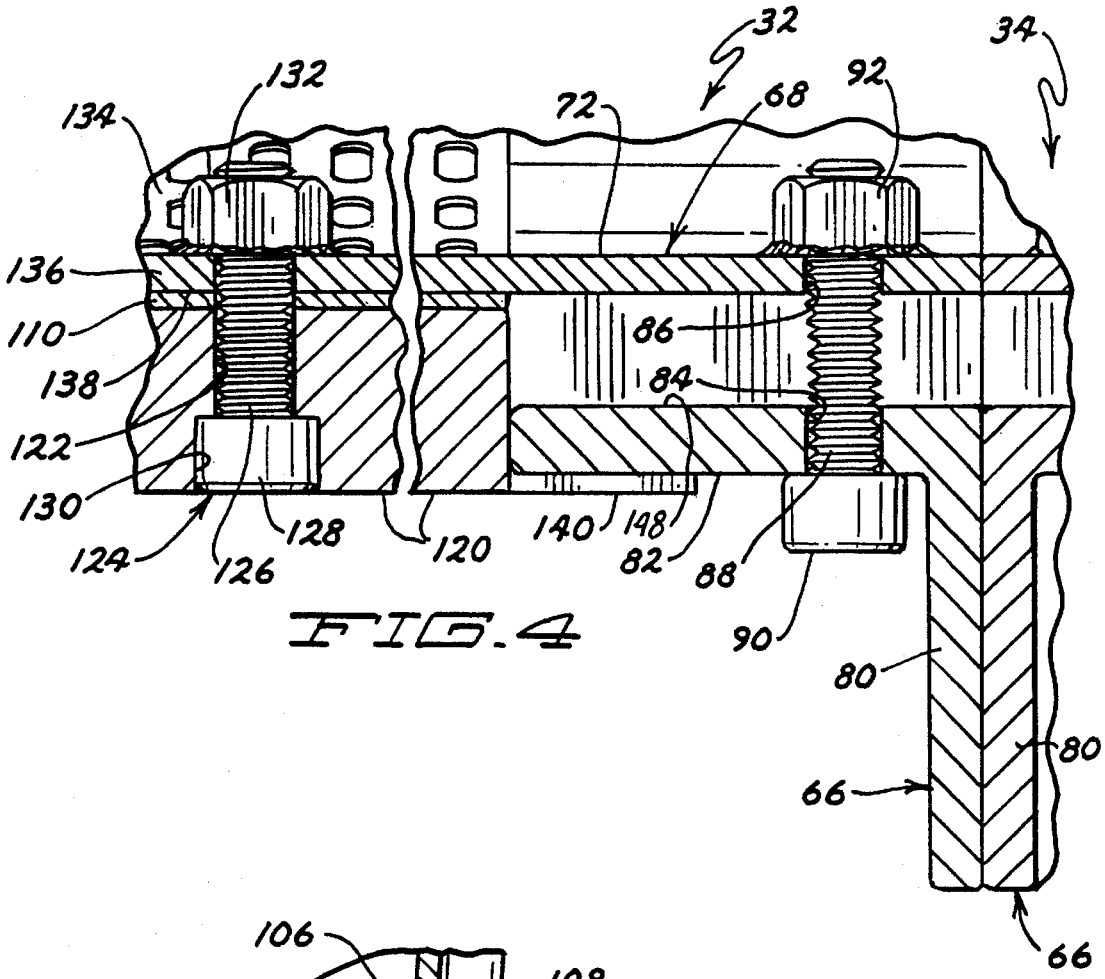
FIG. 4 is a cross sectional view of portion of the sizer apparatus circumscribed by the circle in FIG. 1 taken along viewing plane 4—4 of FIG. 2.
Figure 3:
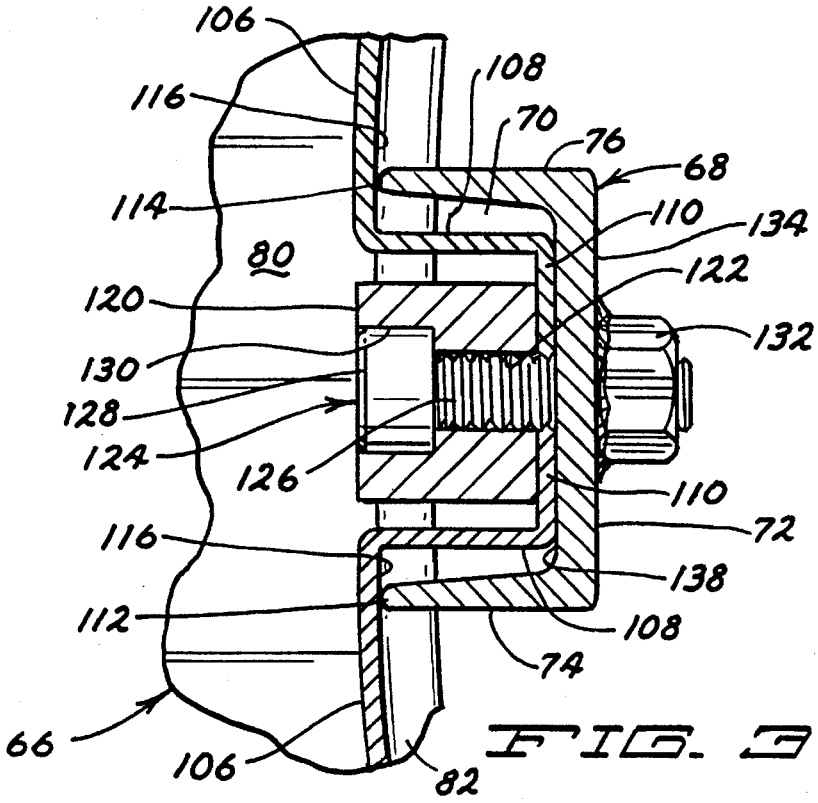
FIG. 3 is a cross sectional view of portion of the sizer apparatus circumscribed by the circle in FIG. 1 taken along viewing plane 3—3 of FIG. 2.
Figure 5:
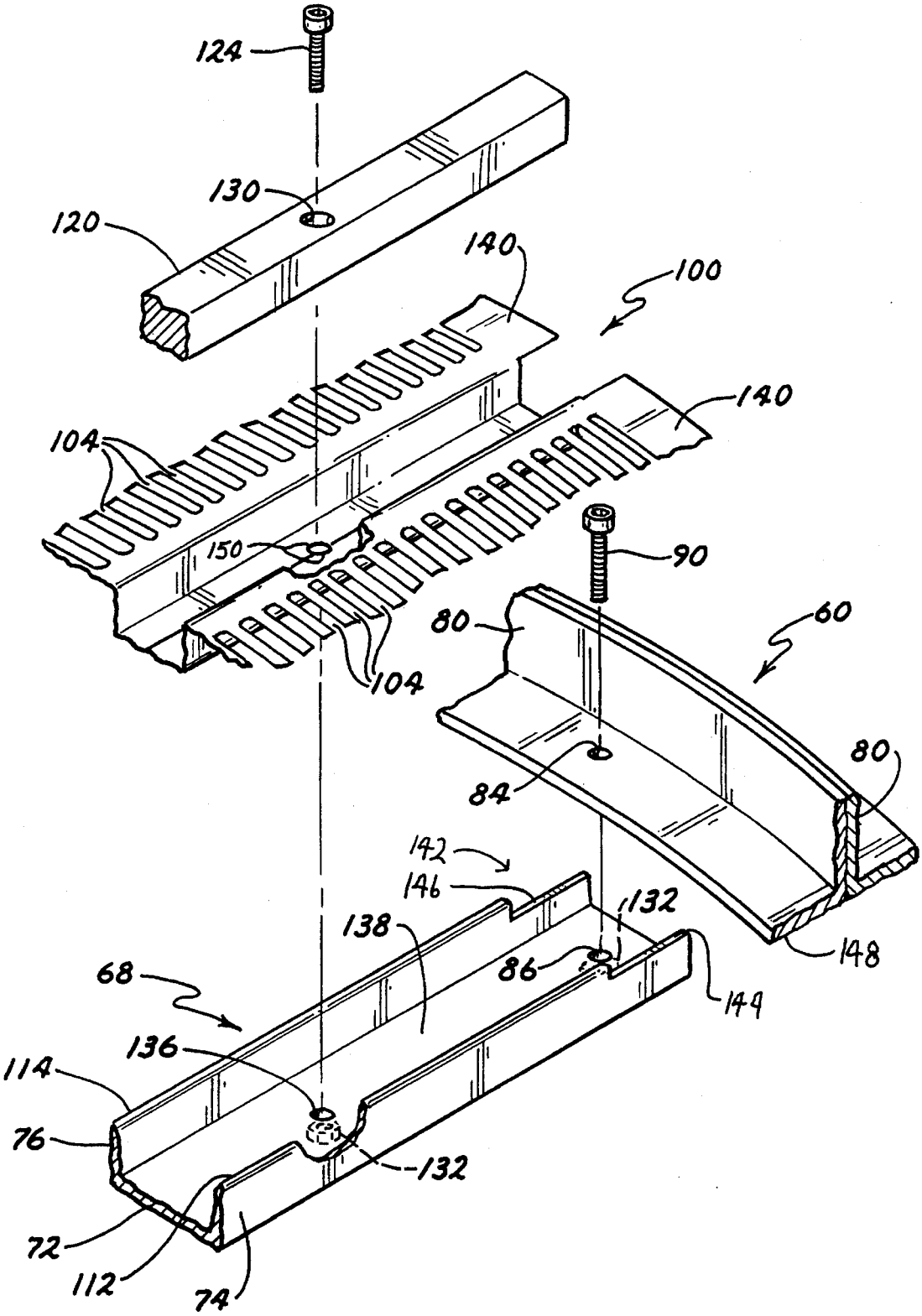
FIG. 5 is an exploded perspective view of a trommel joint with a pair of screen panels and a rib with a channel in accord with the present invention.

Referring now to FIGS. 2–5, it will be seen that trommel 10 includes a skeleton frame 60 that provides the structural support for each of the screening sections 30–36. Each screening section comprises a screen 62 comprising a plurality of screen panels 64 (FIG. 1) connected to each other and to the skeleton frame 60 in a manner to be hereafter described. The frame of each screening section includes a pair of substantially circular L-shaped end rings 66 with a plurality of longitudinally extending ribs 68. The ribs 68 and the end rings 66 may be cross braced in any known manner as desired to provide the desired structural integrity to the trommel frame 60. Each rib 68 defines an outwardly facing channel 70 formed by the u-shaped ribs 68 (FIG. 3). That is, each rib includes a base web 72 and a pair of spaced apart, generally upright side webs 74 and 76 that together form the three sided channel 70. Referring particularly to FIGS. 2 and 4, it will be seen that the end rings 66 has a substantially L-shaped configuration in cross section and includes an upright member 80 and a longitudinally extending member 82. The longitudinal member 82 includes an aperture 84 and the base web 72 of the rib 68 includes an aperture 86. Apertures 84 and 86 receive the threaded shaft 88 of a bolt 90 that is screwed into a nut 92, which if desired, may be welded to the base web 72 as shown so as to attach the rib 68 to the end ring 66. The end ring 66 of section 32 and the end ring 66 of section 34 may be attached to each other in any known manner preferred, including welding or bolting with suitable bolts. Referring now to FIG. 5, the screen panels 64 will be described. It will be understood that each screen panel 64 is substantially similar to the other screen panels and that therefore a description of one will suffice for a description of all. Screen panels 64 each comprise a screening portion 100 and an attachment portion 102. Screening portion 100 includes a plurality of sorting holes or apertures 104 through which the material to be sorted passes. Sorting holes 104 will, of course, be differently configured and sized depending upon the type of material to be sorted or sized and upon the type of sorting or sizing to be performed. Each screening panel 64 preferably has an arcuate configuration with a radius of curvature equal to that of the trommel 10. As indicated in FIG. 1, six such screening panels 64 may be attached to the skeleton frame 60 of each screening section, though greater of fewer may be used if desired. The attachment portion 102 of each screen panel 64 includes an arcuate section 106, an inwardly extending, substantially radially directed, member or arm 108, and a laterally directed member or arm 110, which substantially forms a right angle with member 108.

To assemble the screen panels 64 to the skeleton frame 60, arms 108 and 110 are received within channel 70 of rib 68 such that the arm 110 lies substantially flush with base web 72 while arm 108 lies substantially parallel to but spaced apart from side web 74 (or 76 on the other end of a particular side web 72). The upper ends 112 and 114 of side webs 74 and 76 respectively engage the under or inner surface 116 of the arcuate section 106. To hold the screen panels 64 in place, a clamp bar 120 is inserted into the channel 70, thereby clamping the lateral arms 110 of two adjacent screen panels between the clamp bar 120 and the base web 72, as best seen in FIG. 3. The clamp bar 120 includes a plurality of through holes 122, which may be recessed as shown in the Figures, to receive a fastener 124 that holds the clamp bar 120 within the channel 70. Fastener 124 may be a threaded bolt having a threaded shaft 126 and a head 128 that is received within the recessed portion 130 of the through holes 122. The threaded shaft 126 of fastener 124 is threadingly received within the threaded bore of a nut 132 that may be welded to the inner surface 134 of the base web 72 in the same manner that nut 92 is welded to base web 72. Base web 72 will include a plurality of similar through holes 136 that receive the threaded shafts 126 of the fasteners 124. Clamp bar 120 may be elongate and have a substantially rectangular configuration in cross section.

State otherwise, each channel 70 will receive the radial and lateral arms 108 and 110, respectively, of two adjacent screen panels 64. The clamp bar 120 will be inserted between the radial arms 108 of the two adjacent screen panels and will clamp the lateral arms 110 thereof of the adjacent screen panels against the outer surface 138 of the base web 72. The clamp bar 120 will then be fastened within channel 70 such as by a plurality of fasteners 124, thereby clamping the screen panels in place along their adjacent edges. The other edges will then be attached to the skeleton frame in a similar manner. When so disposed, an overlap portion 140 of the screen panel will overlap and lie or bear against the longitudinal member 82 of the end ring 66 and will extend circumferentially therealong.

Referring now to FIG. 5 specifically, other features of the present invention will be described. It will be seen that rib 68 includes a notch 142 cut into the end thereof in the upper ends 112 and 114 of side webs 72 and 74, thereby exposing substantially planar upper surfaces 144 and 146 of side webs 72 and 74 respectively. These surfaces 144 and 146 will be disposed flush against the inner surface 148 of longitudinal member 82 when the rib 68 is attached to end ring 66. It will be understood that the other end of the rib 68 will include a similar notch 142.

It is also seen in FIG. 5 that the adjacent screen panels 64 can be manufactured so as to be disposed with the edges of adjacent lateral members 110 lying flush against each other. In this embodiment, a plurality of semicircular notches 150 needs to be made in the lateral members 110 so that together they adjacent semicircular notches provide an aperture for the shaft 126 of bolt 124. Alternatively, the screen panels 64 can be constructed such that the edges of the lateral members do not lie flush with each when assembled but instead are spaced apart at distance approximating the diameter of the shaft 126 of bolt 124.

In addition to the previously described advantages, the present invention allows a damaged screen panel to be readily changed for a new screen panel, thus preventing long shut downs of the trommel 10 due to damage to the screen. In addition, whereas with a prior art 360° screen, it would be necessary to replace the entire screen were damage to occur, with the present invention only a small portion of the screen needs to be replaced. In addition, as previously described, attaching a plurality of screen panels along their longitudinal edges as discussed above and shown in the Figures reduces the amount of fatigue in the screen panel and reduces, if not eliminates the prior art problem of 360° screens cracking along their circumferential edges.

The present invention having thus been described, other modifications, alterations, or substitutions may now suggest themselves to those skilled in the art, all of which are within the spirit and scope of the present invention. It is therefore intended that the present invention be limited only by the scope of the attached claims below.

What is claimed is:

1. A trommel comprising:

a frame comprising a pair of substantially circular spaced apart end rings and a plurality of longitudinally extending ribs, each rib extending between and attached to said end rings, each said rib defining a channel that faces outwardly; and a plurality of screen panels including a screening portion and an attachment portion, said screening portion having a plurality of sizing holes, said attachment portion including a radial arm extending inwardly from said screening portion and a lateral arm extending away from said screening portion and away from said radial arm at substantially a right angle thereto, wherein said radial arms and said lateral arms of adjacent screen panels are received within said channel and fastened therein.

2. The trommel of claim 1 wherein each said rib comprises a base web and a pair of side webs, said side webs extending outwardly from said base web, said base web and pair of side webs defining said channel of said rib.

3. The trommel of claim 2 and further including a plurality of clamp bars and wherein two adjacent screen panels are fastened to one of said ribs by a said clamp bar, said clamp bar being received within said channel between said radial arms of said adjacent screen panels such that said clamp bar clamps said lateral arms of said adjacent screen panels between said clamp bar and said base web of said rib.

4. The trommel of claim 1 and further including a plurality of clamp bars and wherein two adjacent screen panels are fastened to one of said ribs by a said clamp bar clamping said lateral arms of said adjacent screen panels within said channel.

5. The trommel of claim 1 wherein said screening portion has an arcuate configuration.

6. The trommel of claim 5 wherein said end rings each have a radius of curvature and said screening portion of said screen panel has a radius of curvature substantially equal to said end ring radius of curvature.

7. The trommel of claim 1 wherein said end ring comprises an upright member and a longitudinal member.

8. The trommel of claim 7 wherein said screening panels further comprise an overlap portion, said overlap portion overlapping and bearing against said longitudinal member of said end ring.

9. A trommel comprising:

a frame comprising a pair of substantially circular spaced apart end rings and a plurality of longitudinally extending ribs, each rib extending between and attached to said end rings, each said rib defining a channel that faces outwardly, said channel being comprising a base web and a pair of side webs, said side webs extending outwardly from said base web;

a plurality of screen panels including a screening portion and an attachment portion, said screening portion having a plurality of sizing holes, said attachment portion including a radial arm extending inwardly from said screening portion and a lateral arm extending from said radial arm portion at substantially a right angle thereto, wherein said radial arms and said lateral arms of adjacent screen panels are received within said channel and fastened therein; and a plurality of clamp bars, wherein two adjacent screen panels are tastened to one of said ribs by a said clamp bar, said clamp bar being received within said channel between said radial arms of said adjacent screen panels such that said clamp bar clamps said lateral arms of said adjacent screen panels between said clamp bar and said base web of said rib.

10. The trommel of claim 9 wherein said screening portion has an arcuate configuration.

11. The trommel of claim 9 wherein said end rings each have a radius of curvature and said screening portion of said screen panel has a radius of curvature substantially equal to said end ring radius of curvature.

12. The trommel of claim 9 wherein said end ring comprises an upright member and a longitudinal member.

13. The trommel of claim 12 wherein said screening panels further comprise an overlap portion, said overlap portion overlapping and bearing against said longitudinal member of said end ring.

14. A trommel comprising:

a frame comprising a pair of substantially circular spaced apart end rings and a plurality of longitudinally extending ribs, each rib extending between and attached to said end rings, each said rib defining a channel that faces outwardly;

a plurality of screen panels including a screening portion and an attachment portion, said screening portion having a plurality of sizing holes, said attachment portion including a radial arm extending inwardly from said screening portion and a lateral arm extending from said radial arm at substantially a right angle thereto, wherein said radial arms and said lateral arms of adjacent screen panels are received within said channel and fastened therein; and a plurality of clamp bars and wherein two adjacent screen panels are fastened to one of said ribs by a said clamp bar clamping said lateral arms of said adjacent screen panels within said channel.

15. The trommel of claim 14 wherein said screening portion has an arcuate configuration.

16. The trommel of claim 15 wherein said end rings each have a radius of curvature and said screening portion of said screen panel has a radius of curvature substantially equal to said end ring radius of curvature.

17. The trommel of claim 14 wherein said end ring comprises an upright member and a longitudinal member.

18. The trommel of claim 17 wherein said screening panels further comprise an overlap portion, said overlap portion overlapping and bearing against said longitudinal member of said end ring.

* * * * *